US009567877B2

(12) United States Patent
Katsumata et al.

(10) Patent No.: US 9,567,877 B2
(45) Date of Patent: Feb. 14, 2017

(54) HERMETICALLY SEALED LASH ADJUSTER

(75) Inventors: Shouji Katsumata, Gotemba (JP); Akihiko Hosaka, Hadano (JP)

(73) Assignees: TOYOTA JIDOSHA KABUSHIKI KAISHA, Aichi-ken (JP); NITTAN VALVE CO., LTD., Handano-shi (JP)

( * ) Notice: Subject to any disclaimer, the term of this patent is extended or adjusted under 35 U.S.C. 154(b) by 259 days.

(21) Appl. No.: 13/061,010

(22) PCT Filed: Aug. 28, 2008

(86) PCT No.: PCT/JP2008/065436
§ 371 (c)(1),
(2), (4) Date: Feb. 25, 2011

(87) PCT Pub. No.: WO2010/023747
PCT Pub. Date: Mar. 4, 2010

(65) Prior Publication Data

US 2011/0162610 A1 Jul. 7, 2011

(51) Int. Cl.
*F01L 1/14* (2006.01)
*F01L 1/24* (2006.01)

(52) U.S. Cl.
CPC ..... *F01L 1/2405* (2013.01); *F01L 1/24* (2013.01); *F01L 2001/2433* (2013.01);
(Continued)

(58) Field of Classification Search
CPC ..... F01L 1/14; F01L 1/20; F01L 1/22; F01L 1/24; F01L 1/25; F01L 1/143; F01L 1/146; F01L 1/245; F01L 1/2405; F01L 1/2411; F01L 2109/00
(Continued)

(56) References Cited

U.S. PATENT DOCUMENTS 2,763,250 A * 9/1956 Bensinger ..... F01L 1/2405 123/90.43
4,402,285 A * 9/1983 Arai et al. ..... 123/90.58
(Continued)

FOREIGN PATENT DOCUMENTS

EP 0 899 429 A1 3/1999
EP 1113147 B1 * 12/2003 ..... F01L 1/24
(Continued)

OTHER PUBLICATIONS

Official Communication pursuant to Article 94(3) in corresponding European Appln. No. 08 809 511.2-2311 dated Oct. 9, 2012.
(Continued)

*Primary Examiner* — Zelalem Eshete
(74) *Attorney, Agent, or Firm* — Sughrue Mion, PLLC

(57) ABSTRACT

A sealed type lash adjuster (100A) includes a plunger (2A), a body (1) in which the plunger (2A) is inserted in a fitting manner, a first sealing means (5) provided between the plunger (2A) and the body (1), and a second sealing member (20A) that can prevent or suppress intrusion of an engine oil from an outside. The second sealing means (20A) seals a portion of the plunger (2A) exposed from the body and is arranged so as to cover a clearance (K) formed between an open end portion of the body and the plunger (2A). More specifically, the second sealing member (20A) has a one-end portion (20*a*A) and an other-end portion (20*b*A) as sealing parts having a function of preventing or suppressing intrusion of the engine oil from the outside.

1 Claim, 5 Drawing Sheets

(52) U.S. Cl.
CPC ..... *F01L 2101/00* (2013.01); *F01L 2109/00* (2013.01); *F01L 2820/01* (2013.01)

(58) Field of Classification Search
USPC ..... 123/90.58, 90.43, 90.45, 90.52
See application file for complete search history.

(56) References Cited

U.S. PATENT DOCUMENTS

| | | | | |
|---|---|---|---|---|
| 4,541,373 | A * | 9/1985 | Ishida | 123/90.55 |
| 4,574,750 | A * | 3/1986 | Kodama et al. | 123/90.58 |
| 4,735,197 | A * | 4/1988 | Ishida et al. | 123/90.58 |
| 4,796,573 | A * | 1/1989 | Wakeman et al. | 123/90.16 |
| 4,807,576 | A * | 2/1989 | Sonoda et al. | 123/90.57 |
| 5,129,373 | A * | 7/1992 | Cuatt et al. | 123/90.55 |
| 5,295,460 | A * | 3/1994 | Dohring et al. | 123/90.58 |
| 5,622,147 | A * | 4/1997 | Edelmayer | 123/90.35 |
| 6,474,277 | B1 * | 11/2002 | Vanderpoel et al. | 123/90.12 |
| 6,883,492 | B2 * | 4/2005 | Vanderpoel et al. | 123/321 |
| 7,156,062 | B2 * | 1/2007 | Vanderpoel | 123/90.59 |
| 8,375,910 | B2 * | 2/2013 | Becker et al. | 123/90.5 |
| 2005/0252484 | A1 * | 11/2005 | Vanderpoel et al. | 123/321 |
| 2008/0308055 | A1 * | 12/2008 | Swanbon et al. | 123/90.46 |
| 2009/0000580 | A1 * | 1/2009 | Proschko | 123/90.11 |
| 2013/0174799 | A1 * | 7/2013 | Itoafa | 123/90.52 |

FOREIGN PATENT DOCUMENTS

| | | | |
|---|---|---|---|
| EP | 2 317 086 | A1 | 5/2011 |
| GB | 2 095 357 | A | 9/1982 |
| JP | 56-121808 | | 9/1981 |
| JP | 61-210206 | A | 9/1986 |
| JP | 62-29605 | B2 | 6/1987 |
| JP | 1-124008 | U | 8/1989 |
| JP | 1-131805 | U | 9/1989 |
| JP | 03-050305 | A | 3/1991 |
| JP | 2000-303807 | A | 10/2000 |
| JP | 2002-285807 | A | 10/2002 |

OTHER PUBLICATIONS

Japanese Office Action for corresponding JP Patent Application No. 2007-058491 drafted Jul. 31, 2009.
Japanese Office Action for corresponding JP Patent Application No. 2007-058491 drafted Mar. 23, 2010.
Extended European Search Report (EESR) for corresponding EP Patent Application No. 08 809 511.2 dated Aug. 19, 2011.
Office Action issued on Oct. 9, 2012, in corresponding Chinese patent application.
Translation of the relevant part of the International Preliminary Report on Patentability for PCT/JP2008/065436.
Chinese Office Action for corresponding CN Patent Application No. 200880131524.7 dated Jan. 30, 2013.

* cited by examiner

HERMETICALLY SEALED LASH ADJUSTER

CROSS REFERENCE TO RELATED APPLICATIONS

This application is a National Stage of International Application No. PCT/JP2008/065436 filed Aug. 28, 2008, the content of which is incorporated herein by reference in its entirety.

TECHNICAL FIELD

The present invention relates to a sealed type lash adjuster, and particularly to a sealed type lash adjuster equipped with sealing means between a plunger and a body.

BACKGROUND ART

Conventionally, there has been practically used a lash adjuster that automatically adjusts a valve clearance provided between an intake or exhaust valve and a cylinder head of an internal combustion engine to substantially zero. With such a sealed type lash adjuster, in the aspect of function, clatter noise generated by interference between the intake or exhaust valve and the cylinder head is eliminated by means of this lash adjuster. Moreover, in the aspect of maintenance, it becomes unnecessary to perform operation for periodically checking and adjusting the valve clearance. The lash adjuster includes, for example, an external oil feed type lash adjuster that utilizes engine oil. In the case of this external oil feed type lash adjuster, if a filled quantity of the engine oil is inappropriate or if degraded oil continues to be used, a risk that air or foreign substance is mixed into the oil increases. Therefore, as a result of these factors, the function of the lash adjuster can be impaired. That is, in the external oil feed type lash adjuster, the function of the lash adjuster depends on whether the engine oil is well maintained or not. On the other hand, the lash adjuster includes a sealed type lash adjuster in which a liquid such as oil is hermetically enclosed. With such a sealed type lash adjuster as just described, the above-described factors impairing the function thereof can be eliminated.

With regard to the sealed type lash adjuster, a sealed type lash adjuster such as shown below has been proposed, for example, in Patent Document 1. The sealed type lash adjuster proposed by Patent Document 1 is equipped with an oil seal having two lips in an X-letter shaped cross section (hereinafter simply called X-seal) between a body and a plunger. This X-seal can seal two liquids on both sides of the seal at the same time. Consequently, this sealed type lash adjuster has a structure to simultaneously prevent outflow of the oil sealed by the X-seal to the outside and intrusion of the engine oil from the outside.

[Patent Document 1]

Japanese Examined Patent Publication No. JP-B-62-029605

SUMMARY OF THE INVENTION

Problem to be Solved by the Invention

Now, in order to prevent the engine oil from being mixed into the oil sealed by the X-seal described above, it is necessary to prevent mixture of the two liquids (engine oil and sealed oil). Moreover, for this purpose, it is necessary to make the X-seal also function as a seal for reciprocating motion. On the other hand, a seal for reciprocating motion generally requires a lubricant film on the sliding surface to reduce abrasion, and as a function, prevents external leakage by taking back the oil film pushed out during a push stage to the inside during a pull stage. However, there is a conflict in making the X-seal described above function as a seal for reciprocating motion.

Here, the operating stroke of the plunger required for a lash adjuster is normally in the approximate range of 2 to 2.5 mm. In addition, the plunger rests at the bottom of the body while the engine is stopped. Therefore, after the engine is cranked up from this state, if the plunger is most extended during the stage in which a cam is on the base circle, the sliding width (stroke) between the plunger and the body can exceed the approximate range of 2 to 2.5 mm. In this regard, the X-seal is normally going to maintain the sealing function thereof by deforming without sliding relative to the body when the plunger makes the reciprocating motion. However, for example, during the engine start-up operation described above, the plunger can slide relative to the body by rapidly extending up. Consequently, in such a situation as this, it is necessary to make the X-seal function as a seal for reciprocating motion to prevent mixture of the two liquids due to movement of the oil film.

On the other hand, the mixture of the two liquids due to movement of the oil film essentially occurs when the stroke of the plunger exceeds the width along which the X-seal contacts the sliding surface of the body. Therefore, in order to prevent the mixture of the two liquids, it is required to provide an X-seal of a size consistent with the stroke of the plunger. On the other hand, it is preferable to have a sealed type lash adjuster that is as compact as possible from viewpoints such as providing a large degree of freedom of design of the internal combustion engine. However, when the stroke of the plunger described above is taken into account, it is considered to be inevitable that the sealed type lash adjuster becomes larger in size with the X-seal that can prevent the mixture of the two liquids. Also, by contrast, it is considered to be difficult to prevent the mixture of the two liquids with an X-seal that can be applied without causing an increase in size. That is, there is a conflict in making the X-seal function as a seal for reciprocating motion. Then, for the reason described above, it has been found difficult to simultaneously prevent not only outflow of the sealed oil to the outside, but also intrusion of the engine oil from the outside with one piece of sealing means provided between the body and the plunger.

Therefore, in view of the problem described above, it is an object of the present invention to provide a sealed type lash adjuster that is capable of preventing or suppressing a liquid from intruding from the outside and being mixed into a liquid sealed inside.

Means for Solving the Problem

The present invention for solving the problem is a sealed type lash adjuster characterized by comprising: a plunger having a reservoir chamber inside; a body in which the plunger is inserted in a fitting manner; a first sealing means provided between the plunger and the body; a cap retainer that is attached to an end portion of the body and restricts protrusion of the plunger; a second sealing means capable of preventing or suppressing intrusion of a liquid from an outside; and a hold member that holds the second sealing means, the second sealing means being provided outside of the cap retainer through the hold member, the second sealing means slidably sealing a portion of the plunger exposed from the body and being arranged so as to cover a clearance formed between an open end portion of the body and the plunger, and the hold member being formed so as to cover the clearance. According to the present invention, sealing may be realized more reliably by separately providing a function part of preventing an outflow of a liquid sealed and a function part of preventing or suppressing intrusion of the liquid from the outside. Thus, according to the present invention, it is possible to prevent or suppress the liquid from intruding from the outside and being mixed into the liquid sealed inside.

According to the present invention, the second sealing means is arranged so as to cover the clearance, and it is thus possible to effectively prevent or suppress of not only intrusion from the liquid from the outside but also intrusion of fine chips. Force is exerted on the sealed type lash adjuster from a cam via a locker arm. At this time, lateral motion (swing) of the plunger may be caused by force having a component in the lateral direction (direction perpendicular to a plunger sliding direction). According to the present invention, the second sealing means can further suppress the lateral motion. Thus, according to the present invention, it is possible to prevent or suppress not only intrusion of the liquid or fine chip from the outside but also abrasion of sliding portions of the plunger and the body.

In this regard, the second sealing means may have an one-end portion that is fixed in close contact to a portion of the plunger exposed from the body to thus seal the portion exposed. That is, according to the present invention, the perfect sealing part may be structured in the above portion. Thus, the present invention is preferable because the present invention is capable of certainly preventing the liquid from intruding from the outside via the above portion and being mixed into a liquid sealed inside.

Effects of the Invention

According to the present invention, it is possible to provide a sealed type lash adjuster capable of preventing or suppressing the liquid from intruding from the outside and being mixed into a liquid sealed inside.

BEST MODES FOR CARRYING OUT THE INVENTION

Best modes for carrying out the present invention will be described below in detain in conjunction with the drawings.

Embodiment 1

Figure 1:
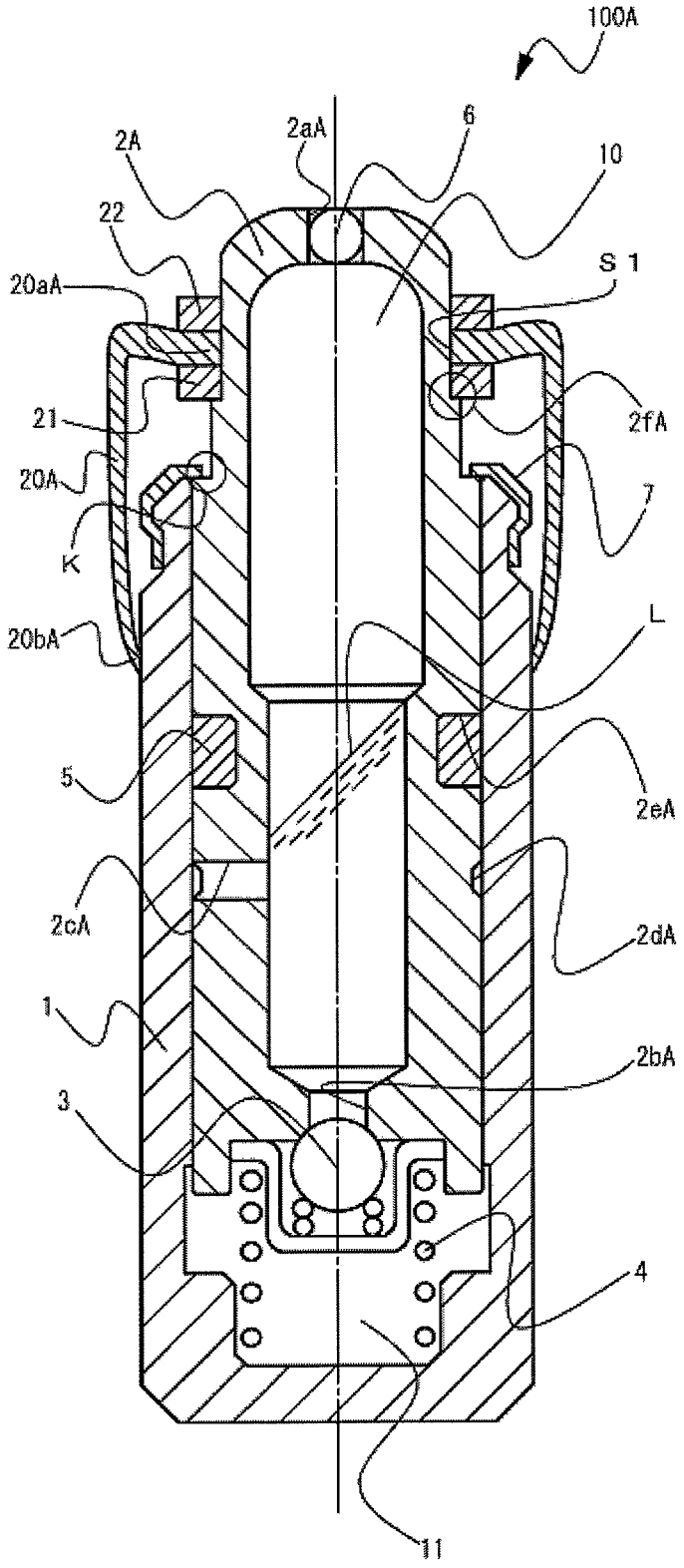
FIG. 1 is a diagram that schematically illustrates a structure of a lash adjuster 100A.

FIG. 1 is a diagram schematically showing a structure of a sealed type lash adjuster (hereinafter also called simply a lash adjuster) 100A according to the present embodiment. As a basic structure, the lash adjuster 100A is structured to include a body 1, a plunger 2A, a check valve 3, a plunger spring 4, a first sealing member (first sealing means) 5, a ball plug 6, and a cap retainer 7.

The body 1 is a member having a cylindrical shape with a bottom, and the plunger 2A is slidably inserted in the cylinder in a fitting manner in the direction parallel to a central axis line thereof. This cap retainer 7 for restricting protrusion of the plunger 2A is arranged at an end portion of the body 1. The cap retainer 7 is structured to function as a retainer for the plunger 2A but not to function to seal a liquid that is going to intrude from the outside. The plunger 2A is a circular column-shaped member, inside which is provided with a reservoir chamber 10. Note that the reservoir chamber 10 may be provided in an appropriate shape. A filling hole 2*a*A for filling oil (liquid) is provided on the end side of the plunger 2A. In addition, the ball plug 6 for sealing the filled oil and gas is pressed into this filling hole 2*a*A. A specified quantity of oil is filled, and the remaining space of the reservoir chamber 10 is taken up by gas (for example, air obtained from manufacturing atmosphere). Silicone oil, for example, can be applied as a sealed oil.

A communication hole 2*b*A communicating with a high-pressure chamber 11 is provided at the rear end portion of the plunger 2A. In addition, the check valve 3 is arranged at this communication hole 2*b*A. The high-pressure chamber 11 is provided on the rear end side of the plunger 2A, and the plunger spring 4 is arranged in this high-pressure chamber 11. The check valve 3 opens to allow only the movement of the oil from the reservoir chamber 10 to the high-pressure chamber 11 when the plunger spring 4 urges the plunger 2A so as to protrude toward the front end side, and shuts off the movement reverse thereto.

In addition, in the plunger 2A, a recycling hole 2*c*A communicating from a sliding surface to the reservoir chamber 10 is provided so that an open portion on the side of the reservoir chamber 10 is always located on the side nearer to the high-pressure chamber 11 than an oil surface L of the oil, in the in-use state. Note that the oil surface L is shown in a state inclined by 45 degrees in FIG. 1 because the lash adjuster 100A according to the present embodiment is assembled to the internal combustion engine (not illustrated) in a state inclined by 45 degrees relative to the vertical direction.

The recycling hole 2*c*A is provided toward the central axis line in a manner orthogonal to the central axis line. On the sliding surface of the plunger 2A, a groove portion 2*d*A is provided around a full circumference at the same height (in the same position in the sliding direction) as that of the recycling hole 2*c*A. In addition, on the sliding surface of the plunger 2A, a groove portion 2*e*A is provided around a full circumference on the side nearer to the front end in the sliding direction than the groove portion 2*d*A. A first sealing member 5 for preventing external oil leakage is arranged in this groove portion 2*e*A. This first sealing member 5 seals a small clearance between the body 1 and the plunger 2A on the side nearer to the front end than the recycling hole 2*c*A. An X-seal, for example, can be applied as the first sealing member 5. However, not limited to this application, any appropriate sealing means such as other parts for sealing purposes may be applied.

With the structure described above being as a basic structure of the lash adjuster 100A, the lash adjuster 100A has a second sealing member (second sealing member) 20A in the present embodiment. This second sealing member 20A has a structure to prevent or suppress intrusion of engine oil (liquid) from the outside. More specifically, the second sealing member 20A is structured to be capable of preventing or suppressing the engine oil from intruding into a clearance K that is formed between an open end portion of the body 1 and the plunger 2A (more specifically, a clearance between the cap retainer 7 arranged in the open end portion and the plunger 2A in the present embodiment). The second sealing member 20A is formed and arranged so as to slidably seal a portion of the plunger 2A exposed out of the body 1 (more specifically, a portion exposed out of the body 1, or further exposed out of the cap retainer 7 in the state in which the plunger 2A is most depressed, which is hereinafter simply called an exposed portion) and to cover the clearance K.

Specifically, the second sealing member 20A is provided with a one-end portion 20*a*A and an other-end portion 20*b*A as sealing parts having a function to prevent or suppress the intrusion of the engine oil from the outside. In the present embodiment, rubber is applied as a material of the second sealing member 20A. However, not limited to this application, any appropriate material may be applied to the second sealing member 20A. More specifically, in the present embodiment, the second sealing member 20A is formed and arranged as described below.

The exposed portion of the plunger 2A has a step shape 2*f*A around the outer circumference. A first cap 21 having a ring shape is pressed in until the first cap 21 is brought into contact with a step of the step shape 2*f*A functioning as a stopper. The one-end portion 20*a*A of the second sealing member 20A has an insert hole 51 passing the exposed portion of the plunger 2A through itself. By fitting the insert hole 51 to the exposed portion, the one-end portion 20*a*A of the second sealing member 20A closely contacts the exposed portion. In this state, a second cap 22 is assembled to the exposed portion by press fitting, and the one-end portion 20*a*A is sandwiched between and held by the first cap 21 and the second cap 22. As a result of the above, the one-end portion 20*a*A is fixed in close contact to the exposed portion of the plunger 2A, and functions as a seal part to prevent the intrusion of the engine oil and seals the exposed portion. That is, as a result of the above, a perfect seal part is applied to the exposed part of the plunger 2A. It is thus possible to prevent the engine oil from intruding from the outside via the exposed portion and being mixed into the oil sealed inside.

On the other hand, the second sealing member 20A is formed so that the other-end portion 20*b*A is in relatively light contact with the outer circumference of the lash adjuster 100A, more specifically, the outer circumference of the body 1 in a state in which the one-end portion 20*a*A is fixed to the exposed portion. The relatively light contact of the other-end portion 20*b*A to the body 1 may be realized by utilizing, for example, contractive force of rubber. The relatively light contact may have a state in which the other-end portion 20*b*A does not closely contact the body 1 but contacts at least a part of the body 1. Thus, the other-end portion 20*b*A functions as a sealing part that prevents or suppress intrusion of the engine oil in the state in which the other-end portion 20*b*A contacts the outer circumference of the body 1. Consequently, the one-end portion 20*a*A and the other-end portion 20*b*A of the second sealing member 20A can prevent or suppress the engine oil from the outside from being mixed into the oil sealed inside.

Since the other-end portion 20*b*A is structured to contact the outer circumference of the body 1, the second sealing member 20A is arranged to cover the clearance K at the same time as the other-end portion 20*b*A is assembled so as to contact the outer circumference of the body 1A. Thus, it is further possible to effectively prevent or suppress intrusion of fine chips. As described above, the lash adjuster 100A is capable of preventing or suppressing the engine oil from intruding from the outside and being mixed into the oil sealed inside.

Embodiment 2

Figure 2:
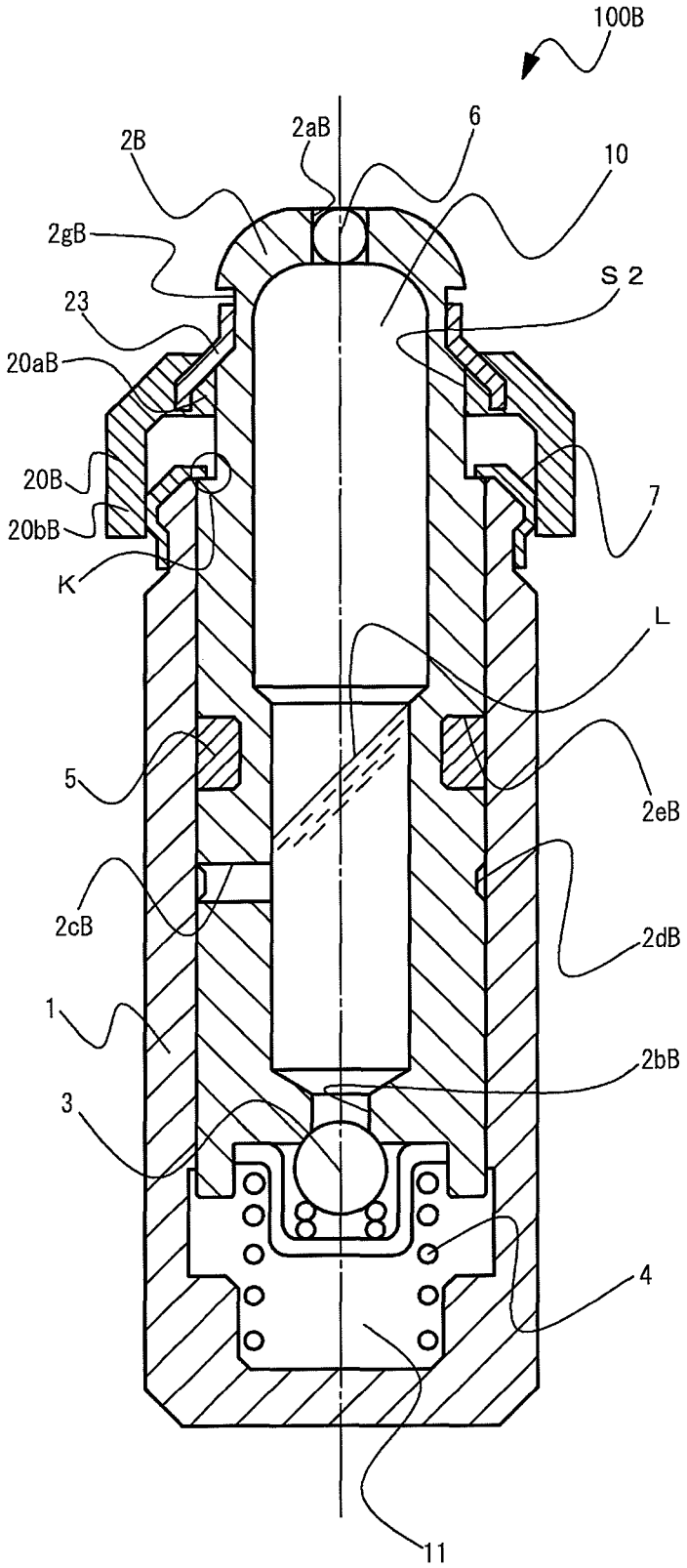
FIG. 2 is a diagram that schematically illustrates a structure of a lash adjuster 100B.

FIG. 2 is a diagram that schematically illustrates a structure of a lash adjuster 100B in accordance with the present embodiment. The lash adjuster 100B has the same basic structure as that of the lash adjuster 100A of the embodiment 1 except that a plunger 2B is substituted for the plunger 2A. In a part other than the basic structure, the lash adjuster 100B differs from the lash adjuster 100A in that the lash adjuster 100B is equipped with a second sealing member 20B and a structure associated herewith (retainer 23) instead of the second sealing member 20A and the structure associated herewith (the first and second caps 21 and 22).

Also, in the present embodiment, the second sealing member 20B is formed and arranged so as to seal the exposed portion of the plunger 2B and cover the clearance K. In this regard, more specifically, the sealing member 20B of the present embodiment is formed and arranged as follows. Also, in the present embodiment, the second sealing member 20B is equipped with a one-end portion 20*a*B and an other-end portion 20*b*B as sealing parts having the function of preventing or suppressing intrusion of the engine oil. Although rubber is used as a material of the second sealing member 20B in the present embodiment, the material is not limited to the above but another appropriate material may be applied.

A groove portion 2*g*B is formed around the outer circumference of the exposed portion. A retainer 23 having a cylindrical shape is fixed to the groove portion 2*g*B by swaging. The one-end portion 20*a*B that defines an insert hole S2 for the plunger 2B is fixed to a lower portion of the retainer 23 through vulcanization bonding. Thus, by swaging the upper portion of the retainer 23 against the groove portion 2*g*B, the one-end portion 20*a*B of the second sealing member 20B is fixed in close contact to the exposed portion of the plunger 2A. Thus, the one-end portion 20*a*B functions as a sealing part that prevents intrusion of the engine oil and seals the exposed portion. It is thus possible to structure the perfect sealing part to the exposed portion of the plunger 2B. It is thus possible to certainly prevent the engine oil from intruding from the outside via the exposed portion and being mixed into the oil sealed inside.

On the other hand, the second sealing member 20B is formed so that the other-end portion 20*b*B is in relatively light contact with the outer circumference of the lash adjuster 100B, more specifically, the outer circumference of the cap retainer 7 in a state in which the one-end portion 20*a*B is fixed to the exposed portion. Thus, the other-end portion 20*b*B functions as a sealing part that prevents or suppress intrusion of the engine oil in the state in which the other-end portion 20*b*B contacts the outer circumference of the cap retainer 7. Consequently, the one-end portion 20*a*B and the other-end portion 20*b*B of the second sealing member 20B can prevent or suppress the engine oil from intruding from the outside and being mixed into the oil sealed inside.

Since the other-end portion 20*b*B is structured to contact the outer circumference of the cap retainer 7, the second sealing member 20B is disposed to cover the clearance K at the same time as the other-end portion 20*b*B is assembled so as to contact the outer circumference of the cap retainer 7. Thus, it is further possible to effectively prevent or suppress intrusion of fine chips. As described above, the lash adjuster 100B is capable of preventing or suppressing the engine oil from intruding from the outside and being mixed into the oil sealed inside.

Embodiment 3

Figure 3:
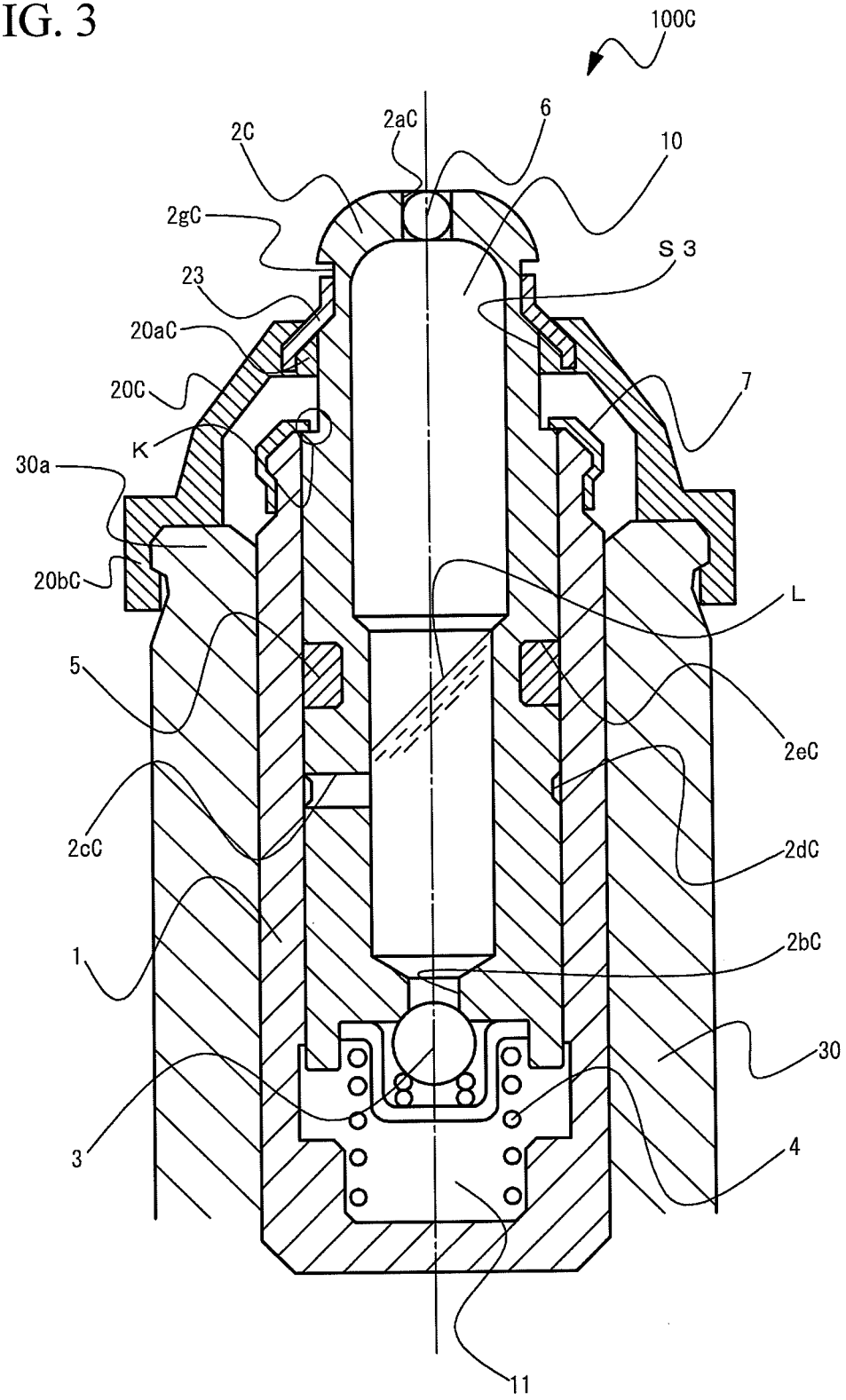
FIG. 3 is a diagram that schematically illustrates a structure of a lash adjuster 100C.

FIG. 3 is a diagram that schematically illustrates a structure of a lash adjuster 100C in accordance with the present embodiment. The basic structure of the lash adjuster 100C is the same as that of the lash adjuster 100A of the embodiment 1 except a plunger 2C is substituted for the plunder 2A. The plunger 2C is the same as the plunger 2B of the embodiment 2. In a part other than the basic structure, the lash adjuster 100C differs from the lash adjuster 100A in that the lash adjuster 100C is equipped with a second sealing member 20C and a structure associated herewith (retainer 23) instead of the second sealing member 20A and the structure associated herewith.

Also, in the present embodiment, the second sealing member 20C is formed and arranged so as to seal the exposed portion of the plunger 2C and cover the clearance K. In this regard, more specifically, the second sealing member 20C of the present embodiment is formed and arranged as follows. Also, in the present embodiment, the second sealing member 20C is equipped with a one-end portion 20*a*C and an other-end portion 20*b*C as sealing parts having the function of preventing or suppressing intrusion of the engine oil. Although rubber is applied as a material of the second sealing member 20C in the present embodiment, the material is not limited to the above but another appropriate material may be applied.

Similarly to the aforementioned one-end portion 20*a*B of the embodiment 2, the one-end portion 20*a*C of the second sealing member 20C forms an insert hole S3 for the plunger 2C and is fixed to the retainer 23. By swaging the retainer 23 against the groove portion 2*g*C, the one-end portion 20*a*C of the second sealing member 20C is fixed in close contact to the exposed portion of the plunger 2A. Thus, the one-end portion 20*a*C functions as a sealing part that prevents intrusion of the engine oil and seals the exposed portion. It is thus possible to structure the perfect sealing part to the exposed portion of the plunger 2C. It is thus possible to certainly prevent the engine oil from intruding from the outside via the exposed portion and being mixed into the oil sealed inside.

The second sealing member 20C is formed so that the other-end portion 20*b*C is attached (fixed) to a structure other than the lash adjuster 100C, more specifically, a fixed portion 30*a* formed on a cylinder head 30 of the internal combustion engine in a state in which the one-end portion 20*a*C is fixed to the exposed portion. The other-end portion 20*b*C and the fixed portion 30*a* are formed around the full circumference of the lash adjuster 100C. Thus, the other-end portion 20*b*C closely contacts the fixed portion 30*a* in a state in which the other-end portion 20*b*C is attached to the fixed portion 30*a*, and functions as a sealing part that prevents intrusion of the engine oil in a state in which the other-end portion 20*b*C is attached to the fixed portion 30*a*. Consequently, the one-end portion 20*a*C and the other-end portion 20*b*C of the second sealing member 20C can perfectly prevent the engine oil from intruding from the outside and being mixed into the oil sealed inside.

Since the other-end portion 20*b*C is structured to contact the fixed portion 30*a* of the cylinder head 30, the second sealing member 20C is disposed to cover the clearance K at the same time as the other-end portion 20*b*C is attached to the fixed portion 30*a*. Thus, it is further possible to effectively prevent or suppress intrusion of fine chips. In sealing of the exposed portion in the embodiment 1 to the present embodiment described above, it is preferable to directly fix the one-end portion 20*a* to the exposed portion in close contact. However, for example, the first cap 21, the second cap 22 or the retainer 23 may have the function of sealing the exposed portion. In this case, the second sealing means is realized by the second sealing member 20, and the first cap 21, the second cap 22 or the retainer 23. That is, the second sealing means may be composed of multiple structures, as described above. The lash adjuster 100C is capable of preventing the engine oil from intruding from the outside and being mixed into the oil sealed inside.

Embodiment 4

Figure 4:
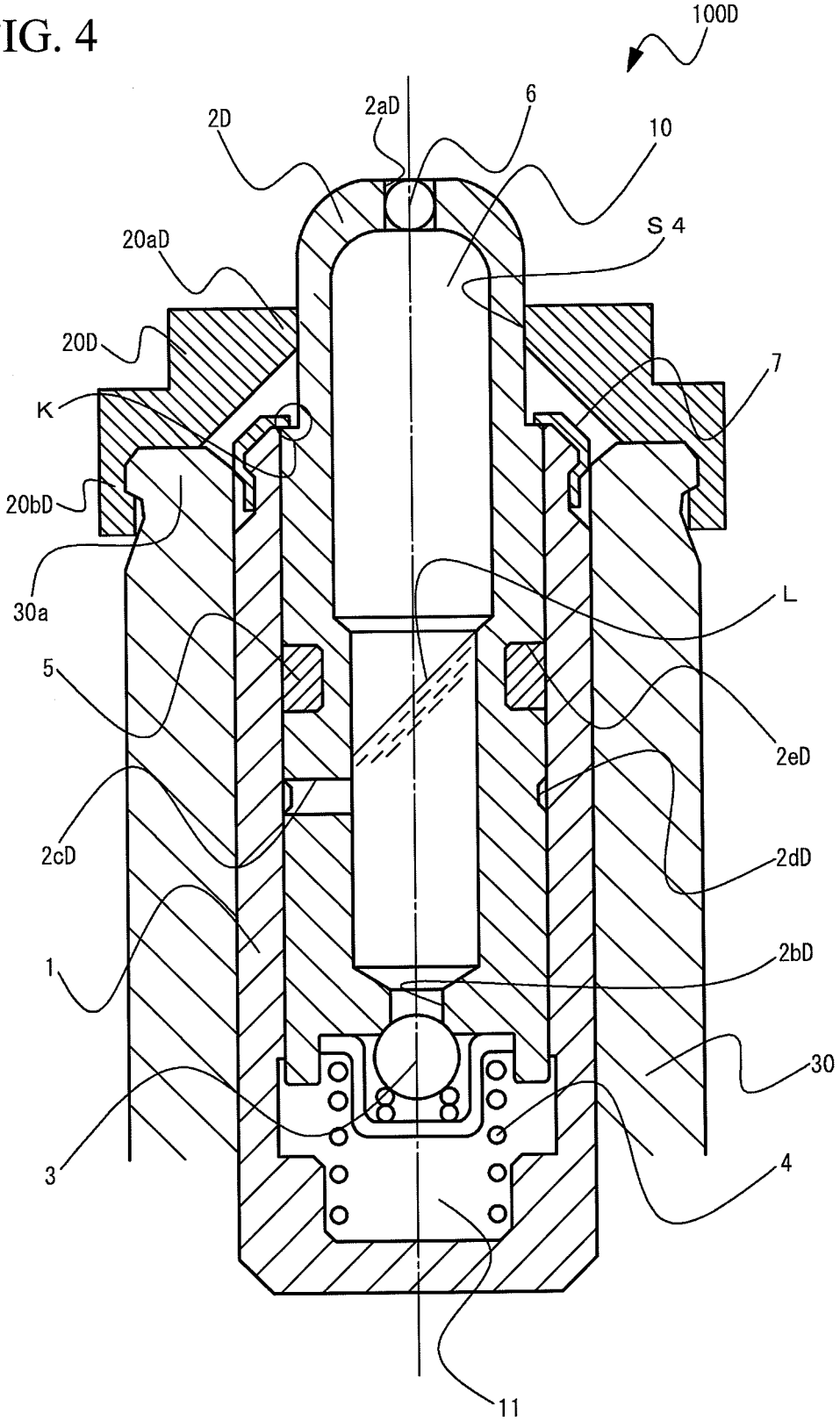
FIG. 4 is a diagram that schematically illustrates a structure of a lash adjuster 100D.

FIG. 4 is a diagram that schematically illustrates a lash adjuster 100D in accordance with the present embodiment. The basic structure of the lash adjuster 100D is the same as that of the lash adjuster 100A of the embodiment 1 in that a plunger 2D is substituted for the plunger 2A. In addition to the basic structure, the lash adjuster 100D differs from the lash adjusters 100A through 100C in that a second sealing member 20D is not structural parts of the lash adjuster 100D originally but is independent parts separate from the lash adjuster 100D. It is to be noted that the second sealing member 20D is used at the same time in practice, and the second sealing member 20D is handled as structural parts of the lash adjuster 100D. That is, although the second sealing means is originally independent parts separate from the lash adjuster, the second sealing means should include any parts simultaneously used with the lash adjuster. The plunger 2D is the same as the plunger 2A except that the step shape 2*f*A is formed in the exposed portion.

Also, in the present embodiment, the second sealing member 20D is formed and arranged so as to seal the exposed portion of the plunger 2D and cover the clearance K. In this regard, more specifically, the second sealing member 20D of the present embodiment is formed and arranged as follows. Also, in the present embodiment, the second sealing member 20D is equipped with a one-end portion 20*a*D and an other-end portion 20*b*D as sealing parts having the function of preventing or suppressing intrusion of the engine oil. Although rubber is applied as a material of the second sealing member 20D in the present embodiment, the material is not limited to the above but another appropriate material may be applied.

The one-end portion 20*a*D of the second sealing member 20D forms an insert hole S4 for passing the exposed portion through itself with a fine clearance, and slidably seals the exposed portion in a state in which the plunger 2D is inserted into the insert hole S4. Thus, the one-end portion 20*a*D functions as a sealing part that prevents or suppresses intrusion of the engine oil and seals the exposed portion.

The second sealing member 20D is formed so that the other-end portion 20*b*D is attached (fixed) to a structure other than the lash adjuster 100D, more specifically, the fixed portion 30*a* formed in the cylinder head 30 of the internal combustion engine in a state in which the plunger 2D is inserted into the one-end portion 20*a*D. The other-end portion 20*b*D and the fixed portion 30*a* are formed around the full circumference of the lash adjuster 100D. In order to fix the other-end portion 20*b*D to the fixed portion 30*a*, more specifically, a diameter-reduced protrusion, for example, is formed on the inner circumference of an end of the other-end portion 20*b*D, a corresponding grooving portion is formed on the outer circumference of the fixed portion 30*a*, and the other-end portion 20*b*D is fitted to the fixed portion 30*a* by swaging. However, the fixing is not limited to the above, but may be realized by means of screwing by forming a male screw and a female screw.

Thus, the other-end portion 20*b*D functions as a sealing part that prevents intrusion of the engine oil in a state in which the other-end portion 20*b*D is attached and fixed to the fixed portion 30A. Therefore, the one-end portion 20*a*D and the other-end portion 20*b*D of the second sealing member 20D is capable of preventing or suppressing the engine oil from intruding from the outside and being mixed into the oil sealed inside. Since the other-end portion 20*b*D is structured to be fixed to the fixed portion 30*a* of the cylinder head 30, the second sealing member 20D is disposed to cover the clearance K at the same time as the other-end portion 20*b*D is attached to the fixed portion 30*a*. Thus, it is further possible to effectively prevent or suppress intrusion of fine chips. Further, in the present embodiment, since the second sealing member 20D is capable of suppressing lateral motion of the plunger 2D, it is possible to suppress abrasion of sliding portions of the plunger 2D and the body 1. As described above, the lash adjuster 100D is capable of preventing or suppressing the engine oil from intruding from the outside and being mixed into the oil sealed inside.

Embodiment 5

Figure 5:
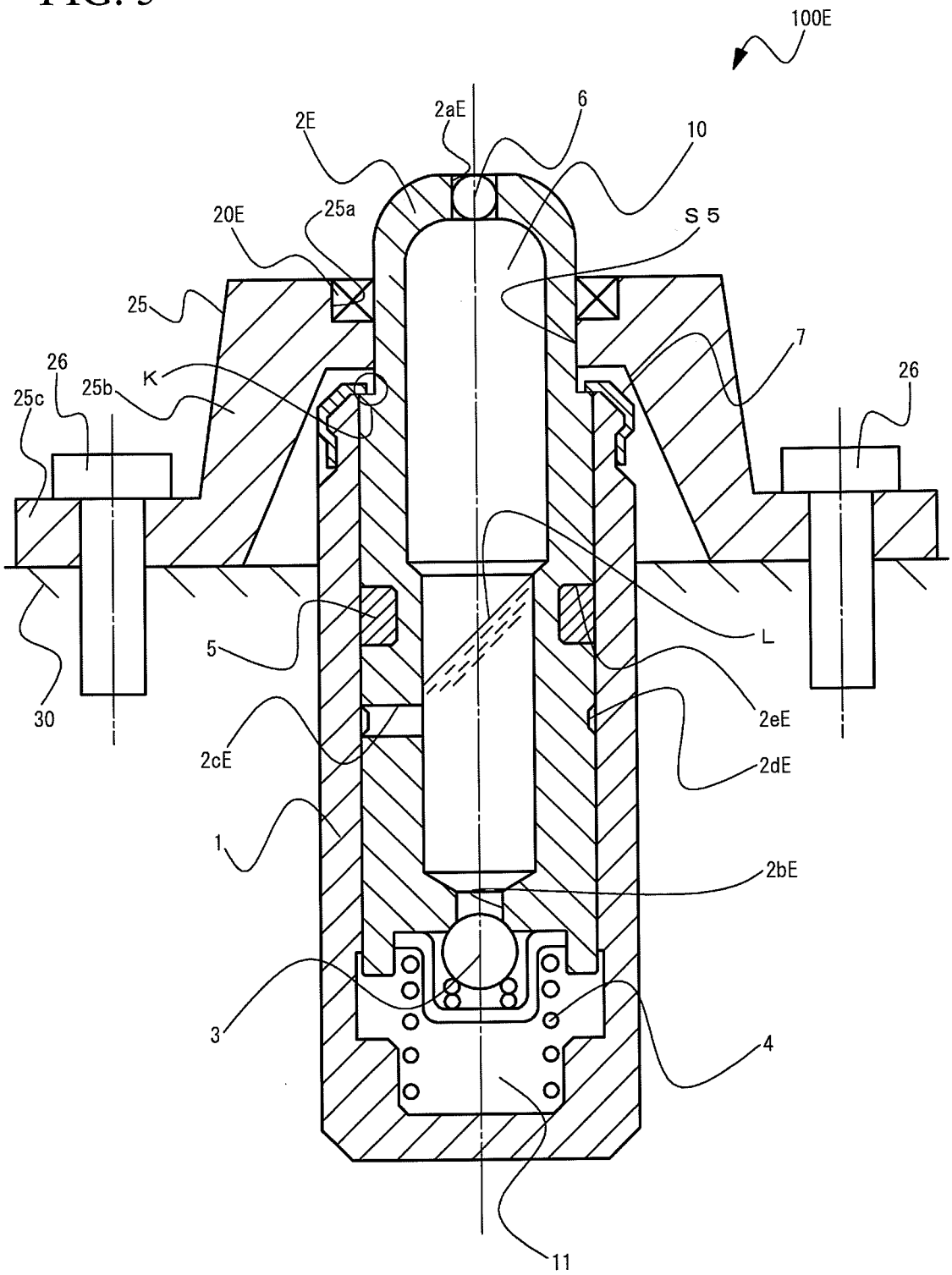
FIG. 5 is a diagram that schematically illustrates a structure of a lash adjuster 100E.

FIG. 5 is a diagram that schematically illustrates a lash adjuster 100E in accordance with the present embodiment. The basic structure of the lash adjuster 100E of the present embodiment is the same as that of the lash adjuster 100D of the embodiment 4. In a part other than the basic structure, the lash adjuster 100E differs from the lash adjuster 100D in that the lash adjuster 100E is equipped with a second sealing member 20E and a structure associated herewith (seal housing 25) instead of the second sealing member 20D. Although the second sealing member 20E and the seal housing 25 are not structural parts of the lash adjuster 100E originally but are independent parts separate from the lash adjuster 100E, the second sealing member 20E and the seal housing 25 are handled as structural parts of the lash adjuster 100E in the present embodiment as in the case of the embodiment 4.

In the present embodiment, the second sealing member 20E slidably seals the exposed portion of the plunger 2E and is disposed by the seal housing 25 (hold member) formed to cover the clearance K. More specifically, the lash adjuster 100E of the present embodiment is structured as follows.

The seal housing 25 has an insert hole S5 passing the plunger 2E through itself, and a hold portion 25*a* for holding the second sealing member 20E is formed in the insert hole S5. The material of the seal housing 25 may be a metal (for example, iron or aluminum). For example, the second sealing member 20E may be assembled to the hold portion 25*a* by pressing fitting. In the present embodiment, the second sealing member 20E is realized by parts for sealing, and may be appropriate sealing parts, which may be a squeeze type of sealing parts such as an O ring and an X ring, or a lip type of sealing parts such as a U packing or a V packing. It is thus possible to slidably seal the exposed portion.

The seal housing 25 has a flange portion 25*c* around a main body 25*b* formed so as to cover the clearance K. The flange portion 25*c* is formed so that a surface fitted to the cylinder head 30 surrounds the lash adjuster 100E. The flange portion 25*c* is fixed to the cylinder head 30 of the internal combustion engine by bolts 26. An appropriate shield means may further be provided between the flange portion 25*c* and the cylinder head 30. It is thus possible to prevent or suppress intrusion of the engine oil between the flange portion 25*c* and the cylinder head 30. It is thus possible to prevent or suppress the engine oil from intruding from the outside and being mixed into the oil sealed inside of the lash adjuster 100E When the flange portion 25*c* is fixed to the cylinder head 30, the seal housing 25 is disposed to cover the clearance K at the same time. Thus, the present embodiment is capable of effectively preventing or suppressing intrusion of fine chips as in the case of the other embodiments. Further, since the present embodiment is capable of suppressing lateral motion of the plunger 2E, it is possible to suppress abrasion of sliding portions of the plunger 2E and the body 1. In the aforementioned embodiment 1 through the present embodiment, the structure of the first sealing member 5 can be simplified. More specifically, for example, a single lip seal rather than the X seal may be applied to the first sealing member 5. As described above, the lash adjuster 100E is capable of preventing or suppressing the engine oil from intruding from the outside and being mixed into the oil sealed inside.

The embodiments described above are examples of preferred embodiments according to the present invention. However, the invention is not limited to these embodiments, but various modifications can be made within the scope that does not depart from the gist of the present invention.

The invention claimed is:

1. A sealed type lash adjuster comprising:

a plunger having a reservoir chamber inside;

a plunger spring that is arranged at a rear end portion of the plunger and provides a force, in a direction toward a front end side of the plunger, to the plunger;

a body in which the plunger is inserted in a fitting manner, and that accommodates the plunger spring inside of the body, the body having an open end portion, the plunger and the open end portion of the body having a clearance;

a first sealing member provided between the plunger and the body;

a cap retainer that is attached to an end portion of the body and restricts protrusion of the plunger;

a second sealing member capable of preventing or suppressing intrusion of a liquid; and a metal hold member that has an inner wall that has an insert hole through which the plunger is inserted and that has a hold portion that is provided at a top of the metal hold member and holds the second sealing member in contact with an outer surface of the plunger, wherein the second sealing member is separate from the cap retainer and is axially closer to the front end side of the plunger than the cap retainer in the direction, and the second sealing member externally surrounds and slidably seals a portion of the plunger exposed from the body to prevent or suppress intrusion of the liquid between the hold member and the portion of the plunger from an outside of the hold member and to further prevent or suppress intrusion of the liquid into the clearance, and wherein the hold member is formed so as to cover the clearance, and is fixed to a cylinder head of an internal combustion engine, the hold member is separate from the body and holds the second sealing member at the outside of the cap retainer, the hold member has a main body having the hold portion, and a flange portion around the main body, and the flange portion has a surface that is fitted to the cylinder head and surrounds the lash adjuster.

* * * * *